US006457497B1

(12) United States Patent
Adriansens et al.

(10) Patent No.: US 6,457,497 B1
(45) Date of Patent: Oct. 1, 2002

(54) FILLING MACHINE COMPRISING ADVANCED CLEANING MEANS

(75) Inventors: Eric Adriansens; Eric Meunier; Rodolphe Saint-Martin, all of Le Havre Cedex (FR)

(73) Assignee: Sidel, Le Havre Cedex (FR)

( * ) Notice: Subject to any disclaimer, the term of this patent is extended or adjusted under 35 U.S.C. 154(b) by 0 days.

(21) Appl. No.: 09/869,429

(22) PCT Filed: Dec. 7, 1999

(86) PCT No.: PCT/FR99/03050

§ 371 (c)(1),
(2), (4) Date: Jun. 28, 2001

(87) PCT Pub. No.: WO00/40504

PCT Pub. Date: Jul. 13, 2000

(30) Foreign Application Priority Data

Jan. 6, 1999 (FR) ..... 99 00115

(51) Int. Cl.[7] ..... B65B 1/04; B65B 3/04; B67C 3/02

(52) U.S. Cl. ..... 141/91; 141/89; 141/90; 134/170

(58) Field of Search ..... 141/86–91; 222/148, 222/149; 134/166 R, 170

(56) References Cited

U.S. PATENT DOCUMENTS

| | | | | |
|---|---|---|---|---|
| 4,964,444 A | | 10/1990 | Hanerus et al. | |
| 5,562,129 A | * | 10/1996 | Graffin | 141/90 |
| 5,782,274 A | * | 7/1998 | Kaneko et al. | 141/90 |
| 5,865,221 A | * | 2/1999 | Ludwig et al. | 141/31 |
| 6,267,157 B1 | * | 7/2001 | Gruson et al. | 141/90 |

FOREIGN PATENT DOCUMENTS

| | | |
|---|---|---|
| EP | 0 673 837 | 9/1995 |
| WO | WO 95/33675 | 12/1995 |

* cited by examiner

*Primary Examiner*—Timothy L. Maust
(74) *Attorney, Agent, or Firm*—Sughrue Mion, PLLC

(57) ABSTRACT

A filling machine (38) includes at least one filling tube (22), whereby a product flows through the tube, which tube is placed opposite the opening of a receptacle (12) that is to be filled. The filling tube is accommodated in a fixed housing that is joined to a support (34) for the filling tube; the housing possesses an orifice (48) whereby the filling tube is placed opposite thereto and the housing also includes a moveable obturating flap (50) that closes the orifice and seals the housing when in a closed position. The machine includes structure that enables a cleaning agent to be circulated inside the housing.

17 Claims, 4 Drawing Sheets

70
22
34
20
18
A1
12
36
40
32
26
24
30
28
10
16
14

FILLING MACHINE COMPRISING ADVANCED CLEANING MEANS

BACKGROUND OF THE INVENTION

The invention concerns a filling machine comprising advanced cleaning means.

The invention specifically concerns machines that make it possible to fill hollow containers, such as bottles or pots with a product, for example, a food product.

Such machines generally comprise a rotating carousel that holds a series of filling spouts. The containers are mounted on the carousel at a given point on the circle that it describes, being arranged below a filling spout. Once the container is placed under the spout, the latter is filled with product in such a way that the product is poured into the inside of the container. When a desired degree of filling is achieved, the feed from the spout is interrupted by a valve installed in the feed circuit of the spout and the container is then removed from the carousel, it being understood that this is before the carousel has made a complete revolution.

The arrangement of the multiple spouts on a carousel makes it possible for the machine to insure the filing of a number of containers simultaneously. It makes it possible to insure filling a significant number of containers in a given period of time, in spite the fact that the filling is an operation that takes a relatively long time. In fact, it is especially necessary to prevent the product from foaming too, much which would lead to an only partial filling of the container or to a loss of product by overflow. A filling machine can thus contain more than one hundred spouts.

Naturally, the filling operation must be carried out while avoiding any contamination of the product. This is critical when the product is a food product and all the more so in the case of, for example, milk products.

Thus, it is necessary to carry out a cleaning of the filling machine at regular intervals, paying particular attention to a thorough cleaning of all the parts of the machine that are intended to come into contact with the product. It is also necessary to take care that the other parts of the machine that are near the product remain clean.

The cleaning can consist of removing all traces of the product, of removing dust and other foreign bodies with the intention of eliminating biological or bacteriological contaminants. In the sense of the present patent, the cleaning may thus include the concepts of washing, disinfecting, decontaminating and sterilizing.

The cleaning is usually carried out with a liquid or gaseous cleaning agent that is allowed to circulate in the circuit contacted by the product on the inside of the machine.

In order to limit the consumption of cleaning agent, and above all to facilitate its recovery with the intention of possible recycling, preferably the agent is allowed to circulate inside a closed circuit.

For this purpose, the method is known of equipping each spout of the filling machine with a moveable cup during a machine cleaning phase, which is brought into position on the corresponding spout. The cup is pressed onto the filling spout in a sealed manner and it is connected to a circuit for evacuation of the cleaning agent. Then, the cup essentially occupies the place of the container under the filling spout. Thus, it is possible to inject the cleaning agent in the feed circuit of the spout in such a way as to insure cleaning of the interior of the spout, of the valve and of the circuit.

However, these known devices do not make it possible to insure the cleaning except for the internal part of the filling spout which is in direct contact with the product. The parts in the immediate area, such as the external surfaces of the spout, are not reached by the cleaning agent.

Still, if impurities accumulate in the area of the spout, they are able, for example, to detach at the moment of filling and to come into contact with the product, and, for example, fall into the container. Thus it is necessary to provide means that make possible an efficient cleaning of the external parts of the spout.

In addition, if the machine has a carousel equipped with a significant number of spouts, it is interesting to provide a mobile structure which makes it possible to put in place all of the cleaning means corresponding to each spout. In the known device previously described, the cups are carried on a mobile structure which moves between a retracted position and a service position. This displacement is carried out in a direction parallel to the axis of rotation of the carousel, the structure retracting toward the bottom.

Still, taking into account this direction of displacement, the latter must travel a relatively great distance to entirely remove the volume necessary in the passage of the containers when the machine is in service. The amplitude of this displacement and the mass of the support structure for the cups thus require the provision of actuators that are themselves voluminous and heavy. Thus, all of the structure and the actuating means are an assembly that is particularly cumbersome so it is difficult to integrate them into the machine.

In addition, the weight and the space required of the assembly make it impossible to mount it on the carousel. This has thus led to mounting this assembly directly on the fixed stand of the machine that implies that the cups cannot follow the rotation of movement of the carousel. The cleaning phase can thus not be carried out unless the carousel is stopped.

This presents a double inconvenience. On one hand, it is thus necessary to provide precise angular indexing machines for the carousel to insure that, when the support structure of the cups is brought to its cleaning position, each of the spouts would be exactly in correspondence with one of the cups. On the other hand, the cleaning cannot be carried out in the course of the rotation of the carousel, certain parts of the feed circuit may not be completely clean. Thus, the circuit generally has a rotating distributor that makes it possible to transfer the product that is stored in a reservoir to each of the spouts carried on the carousel. Since the cleaning is carried out during a stop, it is difficult to guarantee complete cleaning of the distributor.

SUMMARY OF THE INVENTION

Thus a goal of the invention is to propose a new design of a filling machine which incorporates the cleaning means that make it possible to insure cleaning of the internal and external parts of the cleaning spout, these means needing to be simultaneously simple, reliable, not cumbersome and easy to place in operation, even in the case of where a machine has numerous spouts.

For this purpose, the invention proposes a filling machine of the type having at least one filling spout through which a product runs, the spout being intended to be placed across from the opening of a container to be filled, characterized in that the filling spout is surrounded by a fixed housing attached to a chassis which supports the spout, the housing having a passage orifice through which the spout is fitted, the housing comprising a mobile closing flap which, in a closed position, closes the orifice and closes the housing in a sealed manner and in that the machine has the means to make a cleaning agent circulate on the inside of the housing.

According to other characteristics of the invention:

- the closing flap is controlled by actuating means between its closed position and an open position, in which the hole of the housing is open;
- the actuating means of the flap comprise a double-action fluid pressure actuator;
- the housing has a tubular shape, the orifice being arranged in a lateral wall of the housing and the closing flap comprises a tubular sleeve which slides on the housing along the axis of the latter;
- at one rear axial end, the flap has a radial collar which slides in a sealed manner in a chamber delimited radially between two cylindrical walls and axially between two radial walls, the front radial wall being provided with an annular opening through which the sleeve of the flap slides in a sealed manner;
- in a sealed manner, the collar separates two parts of the chamber, each of which can be connected selectively to a source of fluid under pressure to cause the displacement of the flap between its open or closed positions;
- the flap is fitted radially on the outside of the housing;
- the housing extends along a direction that is essentially perpendicular to the direction of flow of the product;
- the cleaning agent is introduced into the housing by the filling spout;
- the cleaning agent is evacuated through an auxiliary port which opens out into the interior of the housing;
- the auxiliary port is fitted at a low point in the housing;
- during filling, a sterile gas is injected into the housing and is evacuated across the orifice of the housing by surrounding the flow of the product between the filling spout and the container;
- the sterile gas is injected into the housing through the auxiliary port;
- the supply to the filling spout is controlled by a valve which is skewed with respect to the spout, the valve being connected to the spout by a feed pipe;
- the valve is fitted below the filling spout;
- the valve is fitted essentially below the container to be filled, the latter itself placed below the filling spout;
- the spout is carried by a rotating carousel and the fixed housing is attached to the carousel; and
- the machine has several filling spouts of which each is enclosed in a fixed housing provided with a mobile obturator that makes it possible to close the housing in a sealed manner.

BRIEF DESCRIPTION OF THE DRAWINGS

Other characteristics and advantages of the invention will be apparent from reading of detailed description that follows, as well as from the attached drawings in which.

DETAILED DESCRIPTION OF ILLUSTRATIVE EMBODIMENTS

Figure 1:
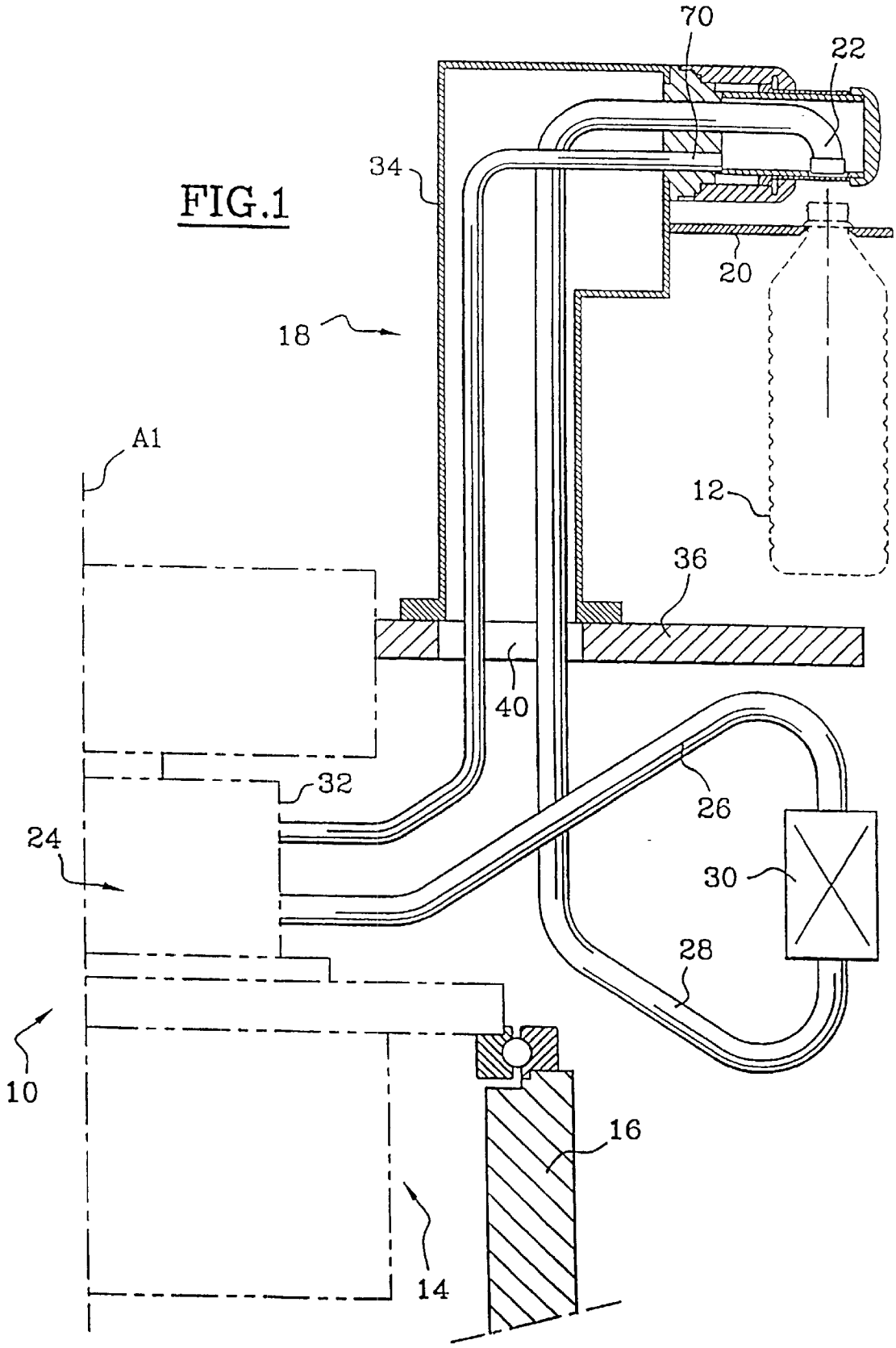
FIG. 1 is a schematic axial cross section illustrating a part of a carousel of a filling machine designed according to the invention.
Figure 2:
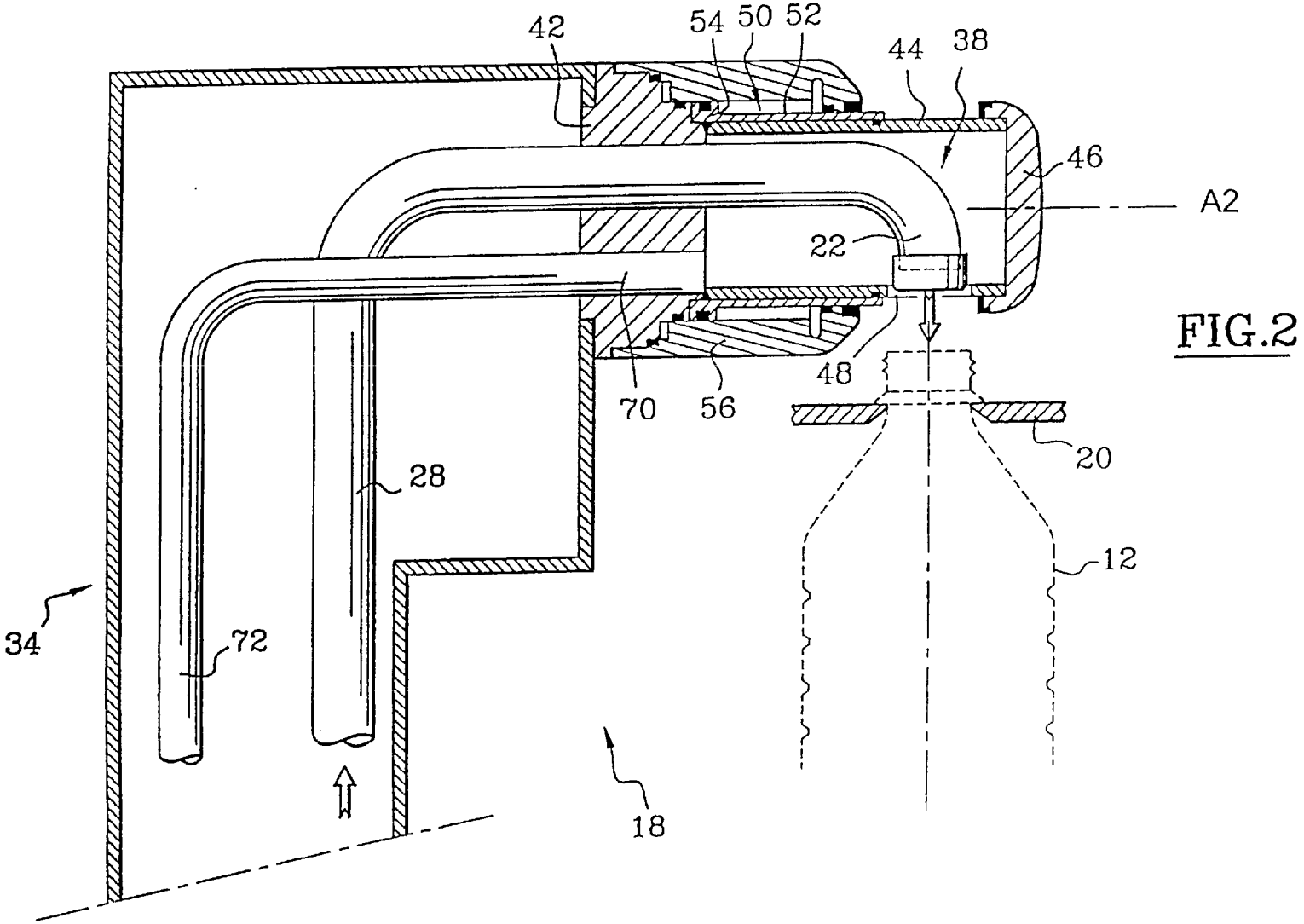
FIG. 2 is a detailed view of FIG. 1 showing, most particularly, the cleaning housing of a filling spout as well as a closing flap and its actuating means, the flap being illustrated in open position.
Figure 3:
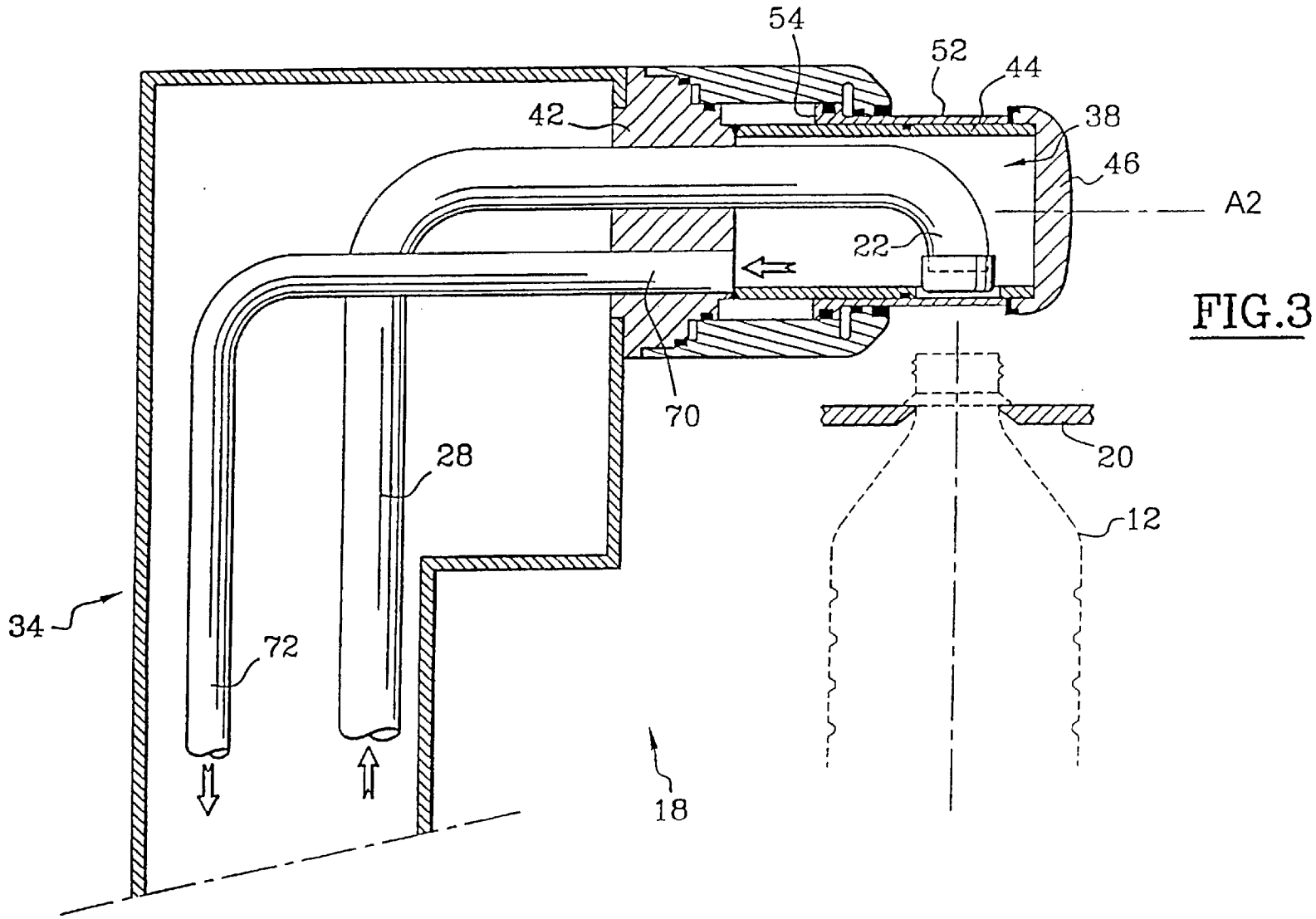
FIG. 3 is a view identical to the one in FIG. 2 in which the flap is illustrated in the closed position.

FIG. 1 schematically and partially illustrates a filing machine 10 intended to insure the filling of containers, such as bottles 12, with a liquid, for example a flat liquid such as water. Naturally, the invention may be used to fill any type of container with any type of product.

The machine 10 is a rotating machine that comprises a carousel 14 mounted so that it turns with respect to a fixed stand 16, around axis A1 that, for the sake of convenience, will be considered to be vertical.

The carousel 14 comprises a series of filling stations 18 that have an offset to each other at an angle in a regular manner around axis A1 but of which a single one is illustrated in the figures. Each filling station 18 is the same for carrying out the filling of a bottle 12. For this purpose, it has in particular a device 20 for supporting bottle 12, a filling spout 22 by which the product intended to fill the bottle pours out, and a feed circuit which is mounted between the spout 22 and a rotating distributor 24 of machine 10.

The feed circuit comprises a feed pipe having two lengths of pipe upstream 26 and downstream 28 between which a valve 30 is fitted which makes it possible to control the flow of product in the circuit and thus the distribution of the product into the container.

The rotating distributor 24 is fitted in the bottom part of carousel 14, radially to the center of same. It comprises a fixed part on which feed pipes (not shown) are arranged which are fastened to stand 16 and which in particular allow the carousel to be supplied with product and in addition, as will be seen later, a cleaning agent and compressed air.

In addition, distributor 24 has a rotating part 32 on which the pipes are connected, including the feed pipes 26, 28. The two parts of the rotating distributor 24 have communication means that make it possible to selectively join the feed pipes fastened to the corresponding pipes of the carousel.

Each filling station 18 comprises a vertical hollow column 34 which is fastened by its lower end to a horizontal plate 36 and which has, at its upper end, the filling spout which extends toward the outside essentially along a radius with respect to axis A1.

Valve 30 is fitted below plate 36, essentially vertical to the associated filling spout 22 in such a way that the upstream piece of pipe 28 of the feed duct extends across a hole 40 in plate 36 to the interior of column 34.

According to the invention, column 34 of the machine described has, at its upper end, a housing 38 in which the enclosed filling spout 22 is found in order to make it easy to clean spout.

As can be seen, especially in FIGS. 2 to 5, the end part of the upstream piece of pipe 28 of the feed pipe extends in a plane that is radial with respect to axis A1 in such a way that the housing is fixed extending radially toward the outside with respect to column 34. The housing 38 comprises a base 42 which is fastened on column 34 and which is extended radially toward the outside by a tubular wall with revolution 44 around radial axis A2. The wall 44 is closed at its external radial end with an end wall 46 which is made up, for example of a plug that is screwed in, in a sealed manner on wall 44.

The end part of the feed pipe 28 crosses base 42 in a sealed manner to open out into the closed space delimited by tubular wall 44. The filling spout 22 is curved toward the bottom to be placed across from an orifice 48 placed in wall 44, this orifice 48 itself being across from the filler opening of bottle 12 when the latter is placed on its support 20.

According to the instructions in the invention, housing 38 comprises a mobile flap 50 which makes it possible to close orifice 48 so that the housing delimits a partially closed and sealed space in which spout 22 is enclosed.

The flap 50 is made up of a tubular sleeve 52 which is mounted so that it slides on tubular wall 44 and on the outside of same. The flap 50 may thus move between an open position illustrated in FIGS. 2 and 4, in which it is pulled back in such a way as to open orifice 48 and a closed position illustrated in FIG. 3 and 5, in which it is moved in such a way as to cover orifice 48.

The rear end of sleeve 52 has the form of a collar 54 which slides in a sealed way in the inside of an annular chamber delimited around the tubular wall 44 by a tubular shell 56 with axis A2 which surrounds the rear end of the wall 44. The collar 54 thus plays the role of a piston which delimits two parts, front 58 and back 60, in the chamber. The respective volume of these two parts 58 and 60 is thus variable as a function of the collar position and thus the position of flap 50 along axis A2.

Also, by imposing a fluid pressure in one or the other of parts 58, 60 of the chamber, a displacement is imposed on flap 50 toward one or the other of these positions, open or closed. In other words, the collar 54 and the two parts 58, 60 of the chamber form an actuator with double-action fluid pressure.

Figure 4:
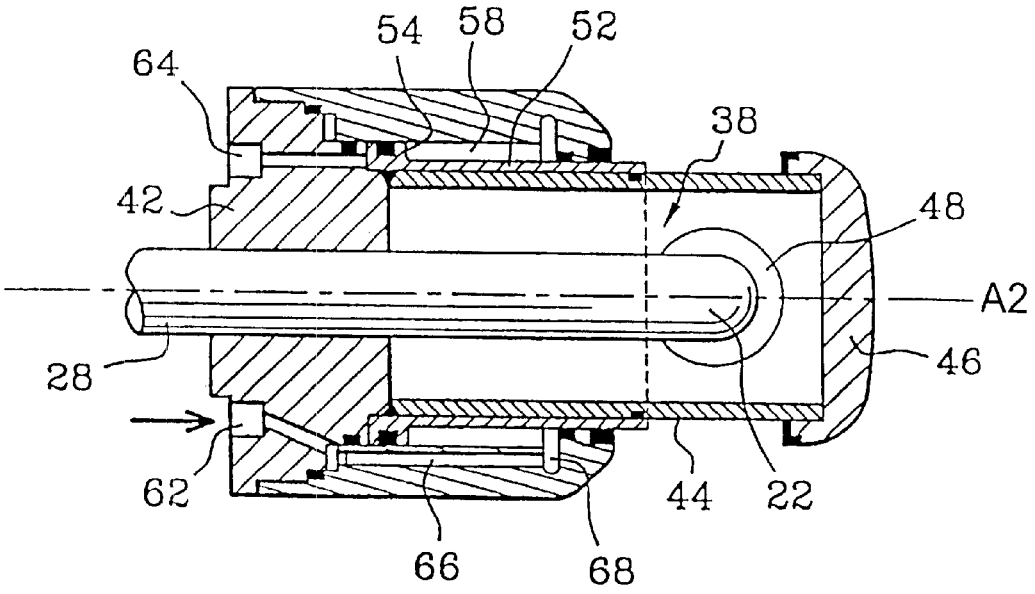
FIGS. 4 and 5 are cross section views along a horizontal plane perpendicular to the axis of rotation of the carousel in which the means for actuating the mobile flap are also shown, the latter being represented in open position and closed position, respectively.
Figure 5:
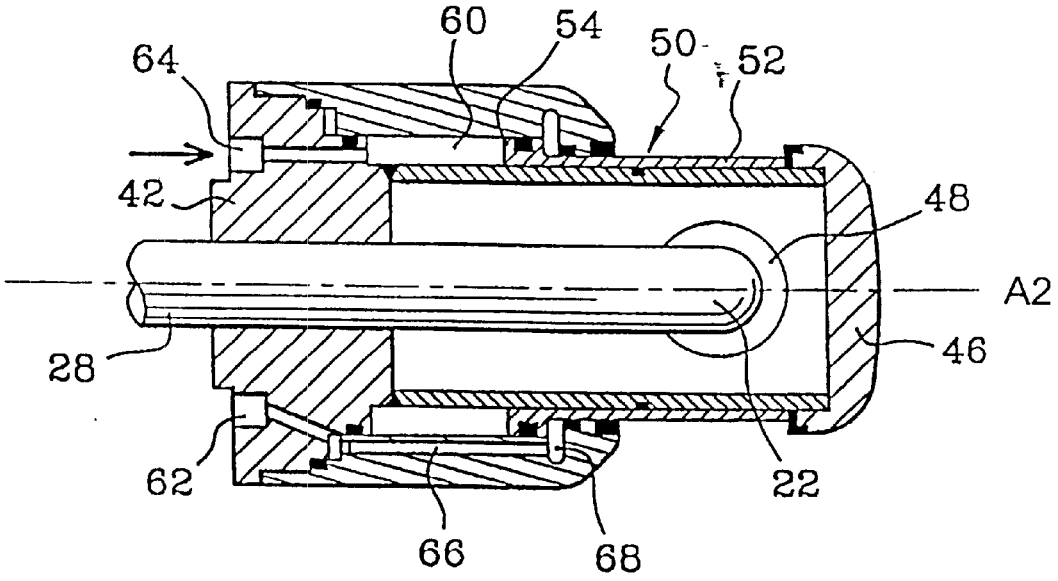

To do this, base 42 of housing 38 has two holes for intake of fluid under pressure, of which a first one 62 is connected to the front part 58 of the chamber and of which the second 64 is connected to the rear part 60. As can be seen in FIGS. 4 and 5, the first intake hole 62 actually communicates with a distributor gallery 66 which is arranged in the thickness of the shell 56 and which extends axially in parallel to the chamber to open out in the front of the shell in an annular throat 68 which is in communication with the front part 58 of the chamber.

When the first inlet hole 62 is connected to a source of fluid under pressure (not shown), the flap 50 is forced toward its rear open position in which the orifice 48 of housing 38 is released. In contrast, when the second inlet hole 64 is connected to the source of fluid under pressure, the flap 50 is forced toward the front to its closing position. In the course of these movements, the tubular sleeve 52 of flap 50 slides in a sealed manner across an annular opening delimited at the front end of the chamber between shell 56 and the tubular wall 44. When the flap is in open position, the sleeve 52 is held almost completely in the interior of the chamber.

This device for actuating the flap is especially simple to put in operation since the majority of the filling machines already use a fluid under pressure as a source of energy for various functions, while the installation of the device does not require the addition of solenoids for control of the supply of the inlet holes 62, 64. In general, the fluid under pressure that will be used is compressed air that can be brought up the housing by the skew of rotating distributor 24. Still, the fluid may also come from a storage reservoir mounted on the carousel.

In addition, the presence of such an actuating device is especially advantageous in that it does not require human intervention directly on machine 10 to open or close flap 50. In fact, such an intervention always remains a possible source of contamination.

When the machine has several spouts, it is possible to provide that each filling station 18 would be equipped with its own control solenoid for flap 50. Actuation of flaps 50 is carried out individually and thus may possibly have a time offset from one spout to another.

However, when the machine has a significant number of filling spouts, the machine may have a single electrical control valve for all the spouts.

In both these cases, due to the invention, the actuation of the flaps can be carried out simultaneously on all the spouts in a very short time. Advantageously, the actuation of the flaps may be carried out when the carousel is in rotation.

However, it would be possible to provide other means of automatic actuation of the flap than those that have been described. The flap could thus be controlled by an autonomous actuator of the pneumatic, hydraulic or electromagnetic type, i.e., by a set of cams.

Still, the mobile flap that was described was made up by a sliding sleeve. However, without leaving the scope of the invention, it would also be possible to provide and implement it any other form, e.g., in the form of an articulated flap.

When housing 38 is closed by flap 50, it is possible to create a cleaning agent circulation on the inside making it possible to clean not just the inside of spout 22, but also the exterior of same. To do this, a cleaning liquid that fills housing 38 is allowed to circulate through the intake duct, valve 30 and spout 22. The liquid is then evacuated from the housing over an auxiliary port 70 which is arranged in base 42 and which opens out into the interior of the housing. The auxiliary port 70 is, e.g., connected by an auxiliary pipe 72 and by the distributor 24 to a recovery and recycling device for the cleaning liquid that makes it possible to limit the consumption.

Preferably the auxiliary port 70 is fitted in such a way as to open out at a low point of housing 38 to make possible the most complete evacuation of the cleaning liquid by the auxiliary pipe 72.

In an advantageous manner, to further improve the cleanliness during filling with the use of such a machine, it can be provided that at the moment of filling, a sterile gas such as sterile air, nitrogen or carbon dioxide is injected into the inside of housing 38. The sterile gas then fills the internal volume of housing 38 and escapes across orifice 48 by surrounding the jet of product that is delivered by the filling spout in the direction of bottle 12. Thus, the product is isolated by a sterile gas envelope between spout 22 and bottle 12 and is not exposed to any possible sources of environmental pollution. Advantageously, the sterile gas may be introduced into housing 38 across the same auxiliary port 70 that is used to evacuate the cleaning agent in the course of the machine cleaning phases.

According to the one of the characteristics of the invention, the valve 30 which controls the circulation of the product in the feed pipe 26, 28 is skewed with respect to the filling spout. In fact, the length of the upstream pipe piece 28 of the pipe that connects valve 30 to spout 22 can reach a length greater than one meter. This provision presents several advantages.

A first advantage is in the possibility of fitting the valve 30 in a location where it is easily accessible to be able to insure maintenance. In fact, in the machine described, it is located in the radial external part of the carousel and not in the center of same, behind spout 22, as in the case in previously known machines.

A second advantage appears in the case of machines having a significant number of spouts 22. In fact, the angular space available for each filling station is limited. By arranging the valves 30, each connected with these spouts 22 on a large diameter circle, with essentially the same diameter on which the spouts are fitted, each valve 30 has a space that is adequate to allow easy installation and such that space requirements will not be a determining factor in choosing the technology used for the valve.

In addition, the since the valve is skewed far from the spouts, it makes it possible to free up a lot of space around the latter. It is thus possible to design the fairings in relatively simple shapes that do not collect dust that is hard to clean.

Finally, the space thus obtained at the level of the filling spout makes it possible to place around it the housing 38 which makes possible simple and efficient cleaning of the spout, since the housing can be of a reduced dimension.

The machine that has just been described is designed in such a way that the filling spout does not come into contact with bottle 12 at the time of filling. However, the person skilled in the art could easily, with the use of his general knowledge, transpose the information in the invention in the case of filling machines in which the spout comes into contact with the bottle, by vertical displacement of the bottle or of the spout.

We claim:

1. A filling machine comprising:

a filling spout through which a product runs, the filling spout being located across from an opening of a container to be filled;

a fixed housing that surrounds the filling spout and is attached to a support of the spout, the housing including, a passage orifice being formed in a wall of the housing through which the spout is fitted, and a mobile closing flap which, in a closed position closes the orifice and closes the housing in a sealed manner, the closing flap comprises a hollow tubular sleeve having a face that is maintained in sliding contact with the housing from a first position that opens the orifice, to a second position that closes the orifice; and means for making a cleaning agent circulate in an interior of the housing.

2. The filling machine according to claim 1, wherein the closing flap is controlled by actuating means between its closed position and an open position in which the orifice of the housing is released.

3. The filling machine according to claim 2, wherein the means for actuating the flap comprise an actuator with double action fluid pressure.

4. The filling machine according to claim 3, wherein at one rear axial end, the flap has a radial collar which slides in a sealed manner in a chamber delimited radially between two cylindrical walls and axially between two radial walls, the front radial wall being provided with an annular opening across which the sleeve of the flap glides in a sealed manner.

5. The filling machine according to claim 4, wherein the collar separates, in a sealed manner, two parts of the chamber of which each can be connected selectively to a source of fluid under pressure to cause the displacement of the flap between the open and close positions.

6. The filling machine according to claim 1, wherein the flap is fitted radially on the outside of the housing.

7. The filling machine according to claim 1, wherein the housing extends along a direction that is essentially perpendicular to a flowing direction of the product.

8. The filling machine according to claim 1, wherein the cleaning agent is introduced into the housing by the filling spout.

9. The filling machine according to claim 8, wherein the cleaning agent is evacuated through an auxiliary port which opens out into the inside of the housing.

10. The filling machine according to claim 9, wherein the auxiliary port is fitted at a low level in the housing.

11. The filling machine according to claim 1, wherein in the course of filling, sterile gas is injected into the housing and evacuates through the orifice of the housing by surrounding the product between the filling spout and the container.

12. The filling machine according to claim 11, wherein the sterile gas is injected into the housing through the auxiliary port.

13. The filling machine according to claim 1, wherein a supply of the filling spout is controlled by a valve which is skewed with respect to the spout, the valve being connected to the spout by a feed pipe.

14. The filling machine according to claim 13, wherein the valve is fitted below the filling spout.

15. The filling machine according to claim 14, wherein the valve is fitted essentially below the container to be filled, the container being placed below the filling head.

16. The filling machine according to claim 1, wherein the spout is held by a rotating carousel and the fixed housing is attached to the carousel.

17. The filling machine according to claim 1, further comprising several filling spouts of which each is enclosed in a fixed housing provided with a mobile closing device making it possible to close the housing in a sealed manner.

* * * * *